United States Patent [19]

Kondo

[11] 4,054,078

[45] Oct. 18, 1977

[54] AUTOMATIC ARPEGGIO ELECTRONIC MUSICAL INSTRUMENT

[75] Inventor: Nobuaki Kondo, Saitama, Japan

[73] Assignee: Kabushiki Kaisha Kawai Gakki Seisakusho, Hamamatsu, Japan

[21] Appl. No.: 719,450

[22] Filed: Sept. 1, 1976

[30] Foreign Application Priority Data

Sept. 3, 1975 Japan ..... 50-106045
Oct. 9, 1975 Japan ..... 50-121256

[51] Int. Cl.[2] ..... G10H 1/02
[52] U.S. Cl. ..... 84/1.24; 84/1.03
[58] Field of Search ..... 84/1.01, 1.03, 1.13, 84/1.17, 1.24, 1.26, DIG. 22

[56] References Cited

U.S. PATENT DOCUMENTS 3,842,184 10/1974 Kniepkamp et al. ..... 84/1.01
3,854,366 12/1974 Deutsch ..... 84/1.24
3,941,024 3/1976 Brand et al. ..... 84/1.01
3,954,035 5/1976 Adams ..... 84/1.01

*Primary Examiner*—Robert K. Schaefer
*Assistant Examiner*—Vit W. Miska

[57] ABSTRACT

An automatic arpeggio musical instrument includes a pulse generator having a plurality of keys for generating periodic pulses by depression of one of the keys, each of the keys generating a voltage, a timing pulse generator connected to the pulse generator, a memory connected to the timing pulse generator for generating digital signals of a musical scale, digital-to-analog converter means connected to the memory for converting the digital signals into analog signals, a processor connected to the converter for selectively adding and subtracting the key-generated voltage to the analog signals, and for generating an output voltage therefrom, and a voltage-controlled oscillator connected to the processor for controlling the output voltage.

6 Claims, 22 Drawing Figures

1
2
3
4
5
6
7
8
9
10
11
12
13
14
15
16
17
18

G3 E3 C3 G2 E2 C2 G1 E1 C1 C1 E1 G1 C2 E2 G2 C3 E3 G3

MEMORY
3
3-1
3-2
3-3
3-4
51-1
51-2
51-3
D/A CONVERTER
4

50
52
53
54
55
56
+V
major
minor 1a
1a-1
1a-2
1a-3
1a-4
1a-5
1a-6
out
RHYTHM PULSE GENERATOR Fig.4(A)
Fig.4(B)
Fig.4(C)
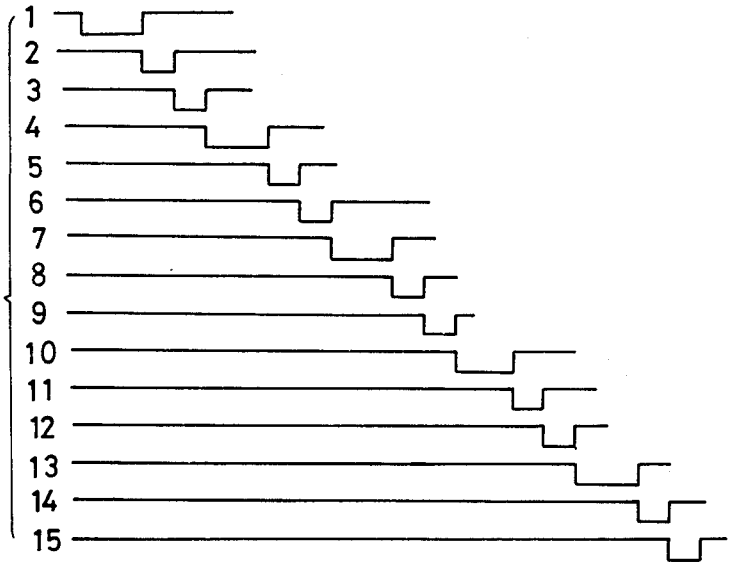
Fig.4(D)
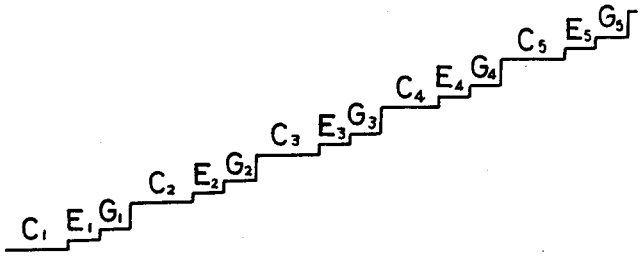
Fig.4(E)
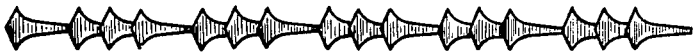

AUTOMATIC ARPEGGIO ELECTRONIC MUSICAL INSTRUMENT

OBJECTS OF THE INVENTION

This invention has for its principal object the provision of an automatic arpeggio apparatus in an electronic musical instrument having a main oscillator of a voltage-controlled type.

Another object of the present invention is to provide an apparatus of the aforesaid type wherein an automatic arpeggio performance according to a rhythm can be given, and an automatic arpeggio performance corresponding to a key depressed can be obtained. An additional object of the invention is to provide such an apparatus of the aforesaid kind wherein words can be written into a memory circuit by depression of a key, and then the words can be reproduced on performance, and furthermore, without carrying out any change in the setting of the circuit memory, the memories in a major scale thereof can be converted into those in a minor scale so that a performance in a minor scale can be given.

SUMMARY OF THE INVENTION

An automatic arpeggio musical instrument includes pulse generator means having a plurality of keys for generating periodic pulses by depression of one of the keys, each of the keys generating a voltage, a timing pulse generator connected to the pulse generator means, memory means connected to the timing pulse generator for generating digital signals of a musical scale, digital-to-analog converter means connected to the memory means for converting the digital signals into analog signals, processor means connected to converter means for selectively adding and subtracting the key-generated voltage to the analog signals and for generating an output voltage therefrom, and a voltage-controlled oscillator connected to the processor means for controlling the output voltage.

The pulse generator means preferably include a rhythm pulse generator, and pulse-width change circuit interconnected between the pulse generator means and the timing pulse generator; the memory means preferably include a read-only memory.

In an alternative embodiment, the memory means includes a read-write memory for storing a plurality of addresses, and a plurality of words, each of the addresses corresponding to one of the words, and the write-read memory has an input and an output. The instrument includes further analog-to-digital converter means having an input and an output, and the analog-to-digital converter means output is connected to the read-write memory input. Voltage generator means for generating the voltage and having an output are connected to the analog-to-digital converter means input, and keying generator means are connected to the timing pulse generator for generating a plurality of pulses following the depression of one of the keys; each of the pulses selects the addresses respectively in sequence, so that a word corresponding to a depressed key is selected and memorized in that memory means.

The musical instrument preferably includes word converting circuit means for converting a word of a major scale into a word of a minor scale and which is interconnected between the memory means and the digital-to-analog converter means.

BRIEF DESCRIPTION OF THE DRAWING

The present invention will be better understood by means of the accompanying drawing, in which:

FIGS. 2A through 2F are waveform diagrams explaining the operation thereof;

FIG. 3 is a circuit diagram showing one example of a rhythm pulse generator;

FIGS. 4A through 4E are waveform diagrams explaining operation of FIG. 1 when the rhythm pulse generator of FIG. 3 is used, and words in a memory circuit are converted;

FIGS. 6–1 through 6—6 are diagrams showing various output pulses of a timing pulse generator, according to the present invention; and FIGS. 7 and 8 are block diagrams showing other embodiments of the present invention.

DESCRIPTION OF THE PREFERRED EMBODIMENTS

Figure 1:
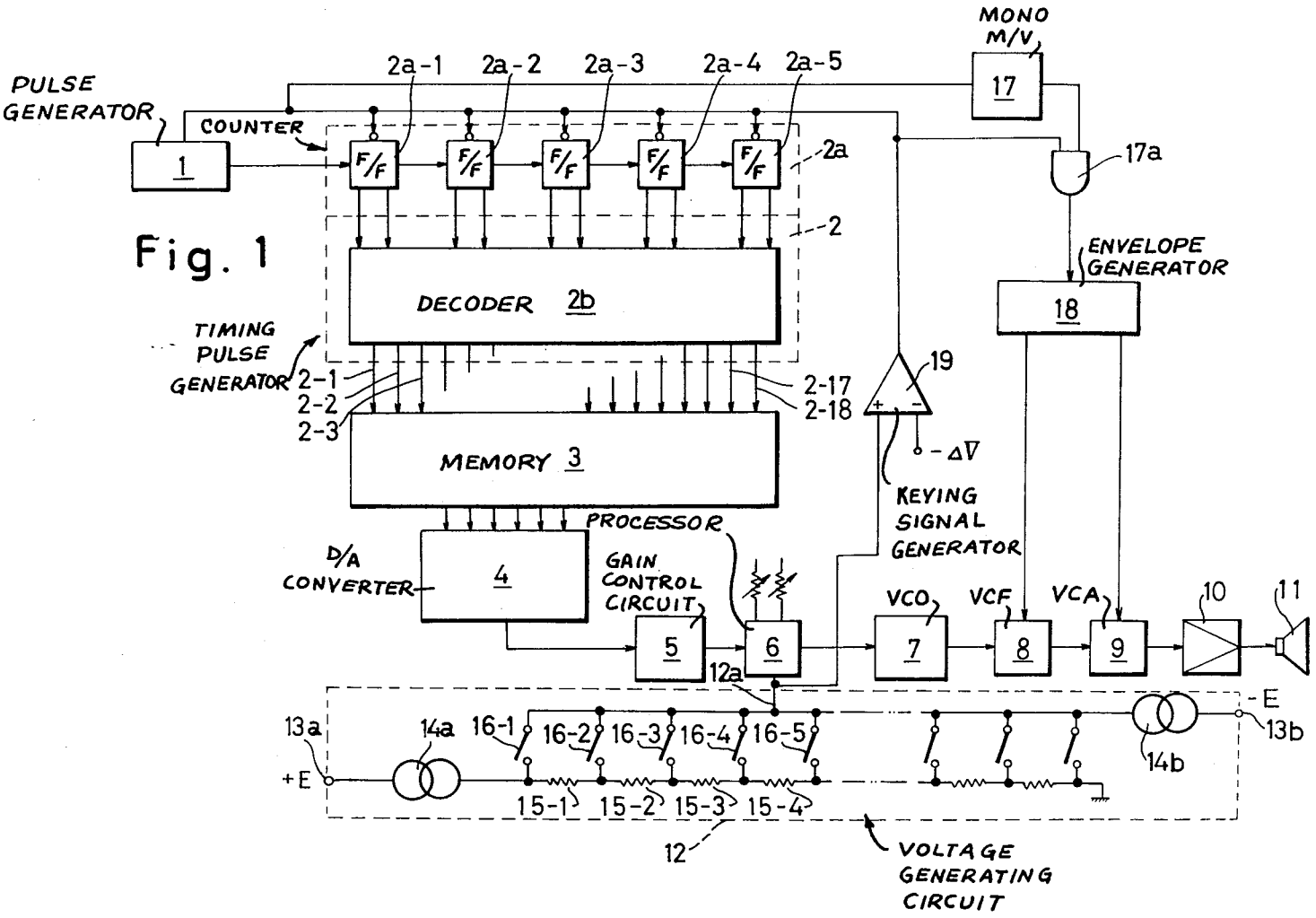
FIG. 1 is a block diagram showing one embodiment of the present invention.

Referring to FIG. 1, numeral 1 denotes a pulse generator which generates pulses repeatedly by depression of a key, numeral 2 denotes a timing pulse generator, numeral 3 denotes a memory circuit, numeral 4 denotes a D-A converter, numeral 5 denotes a gain control circuit, numeral 6 denotes a calculation or processor circuit, numeral 7 denotes a voltage controlled type main oscillator (called hereinafter "VCO 7"), numeral 8 denotes a voltage controlled type filter (called hereinafter "VCF 8"), numeral 9 denotes a voltage controlled type amplifier (called hereinafter "VCA 9"), numeral 10 denotes an amplifier, and numeral 11 denotes a speaker, and these components are sequentially connected.

Figures 2, 2A, 2C, 2D, 2E, 2F:
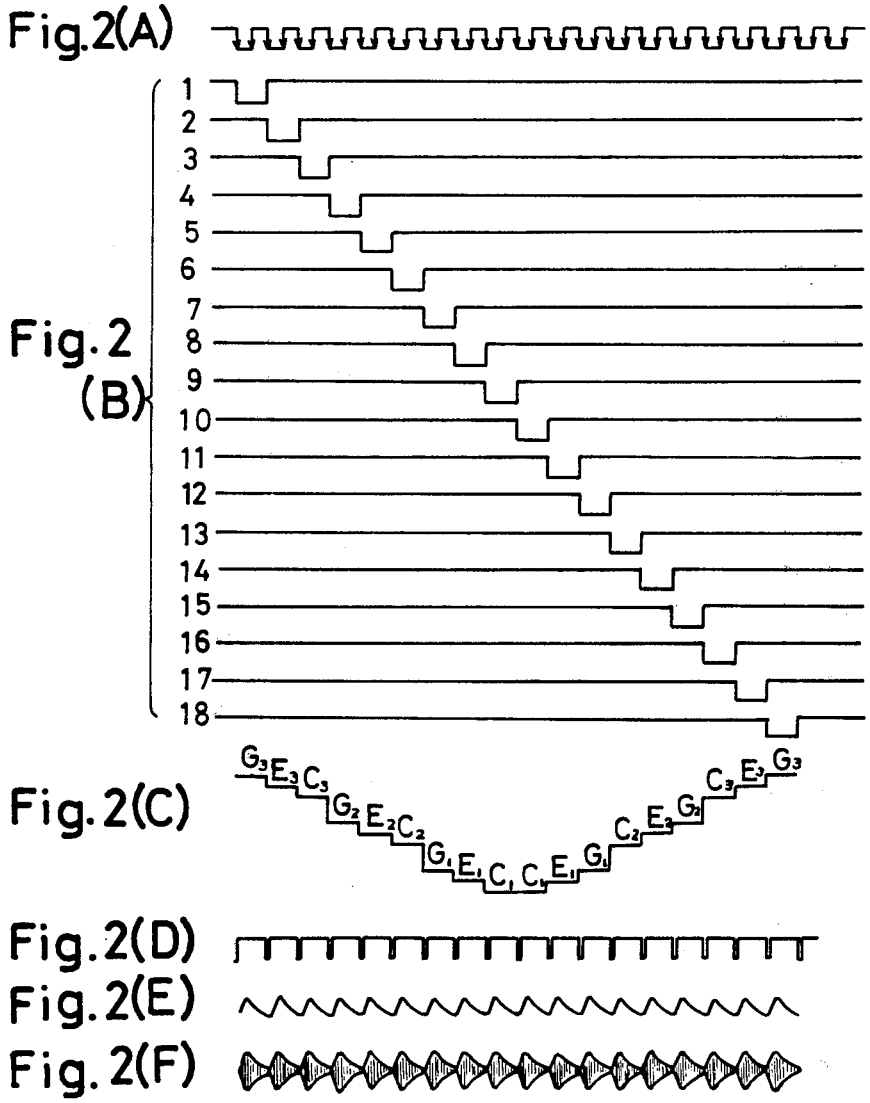

The timing pulse generator 2 includes a counter 2*a* and a decoder 2*b*, so that if the pulse generator 1 generates pulses as shown in FIG. 2A, there may be obtained in sequence at the plural output terminals 2-1, 2-2, . . . . 2-18 of the decoder 2B timing pulses as shown in FIG. 2B, and sequentially shown as 1,2. . . .18. Numerals 2*a*-1, 2*a*-2 . . . . 2*a*-5 denote flip-flop circuits constituting the counter 2*a*.

The memory circuit 3 includes a matrix circuit, and a read-only memory, for instance, is used for the matrix circuit.

Numeral 12 denotes a voltage generating circuit which generates a voltage corresponding to a key depressed, and an output 12*a* thereof is connected to an input terminal of the processor or calculation circuit 6. The voltage generating circuit 12 includes plural series resistances 15-1, 15-2 . . . . connected through a constant electric current circuit 14*a* to a positive electric source terminal 13*a*, and there are provided key-switches 16-1, 16-2 . . . . at respective contacts of the resistances 15-1, 15-2 . . . . , and these key-switches 16-1, 16-2 . . . . are connected in common to the output terminal 12*a*, and through a constant electric current circuit 14*b* to a negative electric source terminal 13*b*.

If, thus, any desired key is depressed, a key-switch corresponding thereto is closed, and a voltage corresponding to the depressed key is generated at the output terminal 12*a* and is applied to the processor or calculation circuit 6.

Numeral 17 denotes a monostable multivibrator driven by output pulses of the pulse generator 1, and an output terminal thereof is connected to the VCF 8 and the VCA 9 through an AND circuit 17*a*, and an envelope signal forming circuit or envelope generator 18. The output terminal 12*a* of the voltage generating circuit 12 is connected through a keying signal generating circuit 19 to a "set" terminal of the pulse generator 1, and "reset" terminals of the counter 2*a*.

The keying signal generating circuit 19 includes an operational amplifier, and is so arranged that a voltage "V" at the output terminal 12*a*, and a standard voltage "−V" are compared with one another, and when "V" is larger than "ΔV", a "1" is generated, and when "V" is smaller than "ΔV" a "O", is generated; and the pulse generator 1 is driven by the logic "1" signal and the counter 2*a* is reset thereby. An output terminal of the keying signal generating circuit 19 is connected to another input terminal of the AND circuit 7*a*.

Prior to explaining how words are memorized in the memory circuit 3, it should be understood that respective musical scale tones can be represented by digital signals of the binary scale, as shown in Table 1; in what follows the tones of a major scale will be denoted by first, second, third . . . . seventh tones of a first octave, second octave, and so on.

Table 1

| Tone designation | Digital signal |
|---|---|
| $C_1$ | 000000 |
| $C\#_1$ | 000001 |
| $D_1$ | 000010 |
| $D\#_1$ | 000011 |
| $E_1$ | 000100 |
| $F_1$ | 000101 |
| $F\#_1$ | 000110 |
| $G_1$ | 000111 |
| $G\#_1$ | 001000 |
| $A_1$ | 001001 |
| $A\#_1$ | 001010 |
| $B_1$ | 001011 |
| $C_2$ | 001100 |
| $C\#_2$ | 001101 |
| $D_2$ | 001110 |
| $D\#_2$ | 001111 |
| $E_2$ | 010000 |
| $F_2$ | 010001 |
| $F\#_2$ | 010010 |
| $G_2$ | 010011 |

If it is now intended to achieve an arpeggio performance for obtaining a fifth tone, a third tone and a first tone of an octave higher by three octaves in relation to a depressed key, and therefore denoted as third octave, and subsequently thereto to obtain a fifth tone, a third tone and a first tone of a second octave, which is lower than the third octave, and still further subsequently thereto to obtain a fifth tone, a third tone and a first tone of a first octave in that order, followed by the first tone, the third tone and the fifth tone of the first octave, the first tone, the third tone and the fifth tone of the second octave, and the first tone, the third tone and the fifth tone of the third octave, it will be understood in view of Table 1 that there must be memorized respective words in respective addresses of the memory circuit 3 as shown in Table 2.

Table 2

| Address No. | Word | Tone | Octave |
|---|---|---|---|
| 1 | 011111 | 5th | |
| 2 | 011100 | 3rd | 3rd octave |
| 3 | 011000 | 1st | |
| 4 | 010011 | 5th | |
| 5 | 010000 | 3rd | 2nd octave |
| 6 | 001100 | 1st | |
| 7 | 000111 | 5th | |
| 8 | 000100 | 3rd | 1st octave |
| 9 | 000000 | 1st | |

Table 2-continued

| Address No. | Word | Tone | Octave |
|---|---|---|---|
| 10 | 000000 | 1st | |
| 11 | 000100 | 3rd | 1st octave |
| 12 | 000111 | 5th | |
| 13 | 001100 | 1st | |
| 14 | 010000 | 3rd | 2nd octave |
| 15 | 010011 | 5th | |
| 16 | 011000 | 1st | |
| 17 | 011100 | 3rd | 3rd octave |
| 18 | 011111 | 5th | |

If therefore a key of the tone $C_1$ is depressed and the key-switch 16-1 is thereby closed, a voltage corresponding to the tone $C_1$ is generated, and it is applied to the processor or calculation input terminal of the processor or calculation circuit 6, and also to the "set" terminal of the pulse generator 1, and the "reset" terminals of the counter 2*a*, so that the pulse generator 1 is activated or driven, and the counter 2*a* then counts output pulses thereof (FIG. 2A); and there are generated at the respective output terminals 2-1, 2-2, . . . . 2-18 of the decoder 2*b* timing pulses shown in FIG. 2 as 1, 2 . . . . 18. These timing pulses are applied in sequence to the respective addresses of the memory circuit 3 and thereby the words shown in Table 2 are outputted therefrom in sequence. Each of these words is converted by the D-A converter 4 into a corresponding analog signal, is gain-controlled by the gain control circuit 5, applied to the processor or calculation circuit 6, and is added onto, or subtracted from a voltage corresponding to the depressed tone key, that is, in the example shown, this is performed for the tone key $C_1$ at the calculation circuit 6, so that there is obtained an analog signal in step form, as shown in FIG. 2C. This analog signal is then applied to the VCO 7, so that the VCO 7 oscillates at a frequency corresponding to that analog signal.

In the meantime, the monostable multivibrator 17 is operated by the output pulses of the pulse generator 1 and generates negative pulses as shown in FIG. 2D, respective rising portions thereof driving the envelope signal generating circuit 18 so that there is obtained on its output side an envelope waveform as shown in FIG. 2E. Thus, the output signal of the VCO 7 is modulated by the VCF 8, the envelope modulated signal being applied to the VCA 9, so that there is obtained an output signal therefrom as shown in FIG. 2F. Thus, since the depressed key is the tone key $C_1$, there can be obtained an arpeggio performance beginning with the fifth tone $G_3$ of an octave higher by 3 octaves than the octave including the tone $C_1$, resulting in the series $G_3\ E_3\ C_3$, $G_2\ E_2\ C_2$, $G_1\ E_1\ C_1$, $C_1\ E_1\ G_1$, $C_2\ E_2\ G_2$, $C_3\ E_3\ G_3$, the suffixes denoting respective octaves. If, then, the depressed key is released, the output pulses of the pulse generator 1 disappear, and the arpeggio performance ceases.

If the tone key $D_1$ is depressed, in almost the same manner as above, an arpeggio including the notes $A_3\ F_3\#\ D_3$, $A_2\ F_2\#\ D_2$, $A_1\ F_1\#\ D_1\ F_1\#\ A_1$, $D_2\ F_2\#\ A_2$, $D_3\ F_3\#\ A_3$ can be obtained.

For obtaining an arpeggio performance of the type which moves from a lower octave to a higher octave in relation to a depressed key, respective words as shown in Table 3 are memorized in respective addresses of the memory circuit 3.

Table 3

| Address No. | Words | Tone | Octave |
|---|---|---|---|
| 1 | 000000 | 1st | |
| 2 | 000100 | 3rd | 1st octave |

Table 3-continued

| Address No. | Words | Tone | Octave |
|---|---|---|---|
| 3 | 0 0 0 1 1 1 | 5th | |
| 4 | 0 0 1 1 0 0 | 1st | |
| 5 | 0 1 0 0 0 0 | 3rd | 2nd octave |
| 6 | 0 1 0 0 1 1 | 5th | |
| 7 | 0 1 1 0 0 0 | 1st | |
| 8 | 0 1 1 1 0 0 | 3rd | 3rd octave |
| 9 | 0 1 1 1 1 1 | 5th | |
| 10 | 1 0 0 0 1 0 | 1st | |
| 11 | 1 0 1 0 0 0 | 3rd | 4th octave |
| 12 | 1 0 1 0 1 1 | 5th | |
| 13 | 1 1 0 0 0 0 | 1st | |
| 14 | 1 1 0 1 0 0 | 3rd | 5th octave |
| 15 | 1 1 0 1 1 1 | 5th | |

Figures 3, 6, 8:
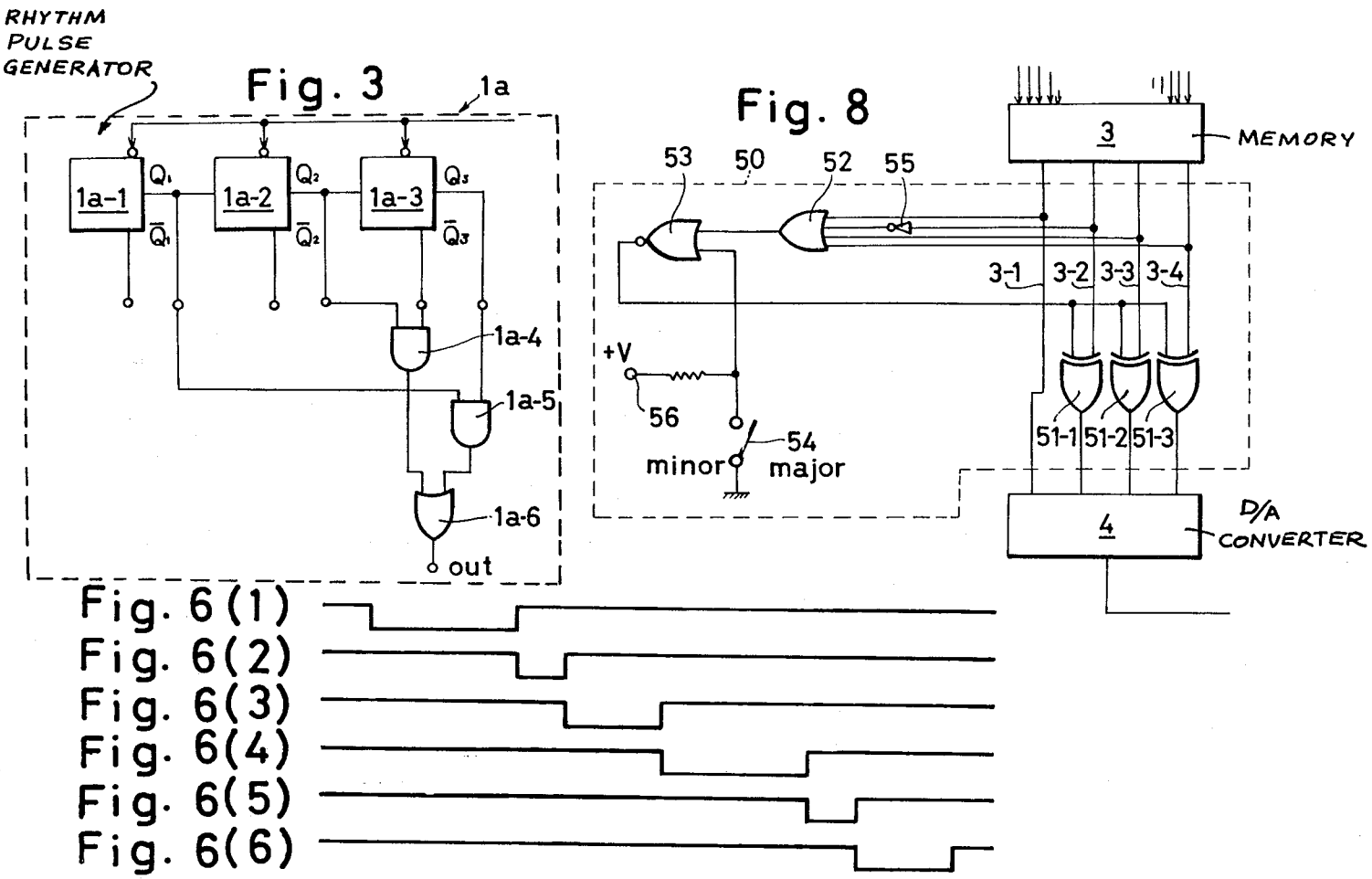

If, therefore, a key of the tone $C_1$ is depressed, for the memory sequence shown in FIG. 3, there is obtained an arpeggio performance including in sequence $C_1 E_1 G_1$, $C_2 E_2 G_2$, $C_3 E_3 G_3$, $C_4 E_4 G_4$, $C_5 E_5 G_5$ by almost the same operation as above-described.

The operation of the pulse generator 1 shown in FIG. 2 has been described for the case where it generates sequentially, pulses identical in waveform, but an arpeggio performance according to any desired rhythm can be obtained, if the pulse generator 1 includes a rhythm pulse generator which generates pulses according to a specific rhythm. A rhythm pulse generator employed, for example, in generating a rhythm for an electronic musical organ may be used.

A rhythm pulse generator 1*a* for obtaining a rhythm as shown in music notation in FIG. 4A, and in time sequence in FIG. 4B, is constructed as shown in FIG. 3. Thus the rhythm pulse generator 1*a* includes a combination of a main oscillator 1*a*-1, two flip-flop circuits 1*a*-2 and 1*a*-3, two AND circuits 1*a*-4 and 1*a*-5, and a single OR circuit 1*a*-6.

Thus, timing pulses according to a rhythm as shown in FIG. 4, denoted respectively by waveforms 1,2 . . . . 15 of FIG. 4 can be obtained from the timing pulse generator 2, and if the words as shown in the Table 3 are memorized in the respective addresses of the memory circuit 3, and a key of the tone $C_1$ is depressed, an analog signal as shown in FIG. 4D is obtained at the output terminal of the processor or calculation circuit 6, and an output signal having an envelope as shown in FIG. 4E is obtained at the output terminal of the VCA 9, so that an arpeggio performance with the notes $C_1 E_1 G_1$, $C_2 E_2 G_2$, $C_3 E_3 G_3$, $C_4 E_4 G_4$, $C_5 E_5 G_5$, in the order shown is obtained.

Figure 5:
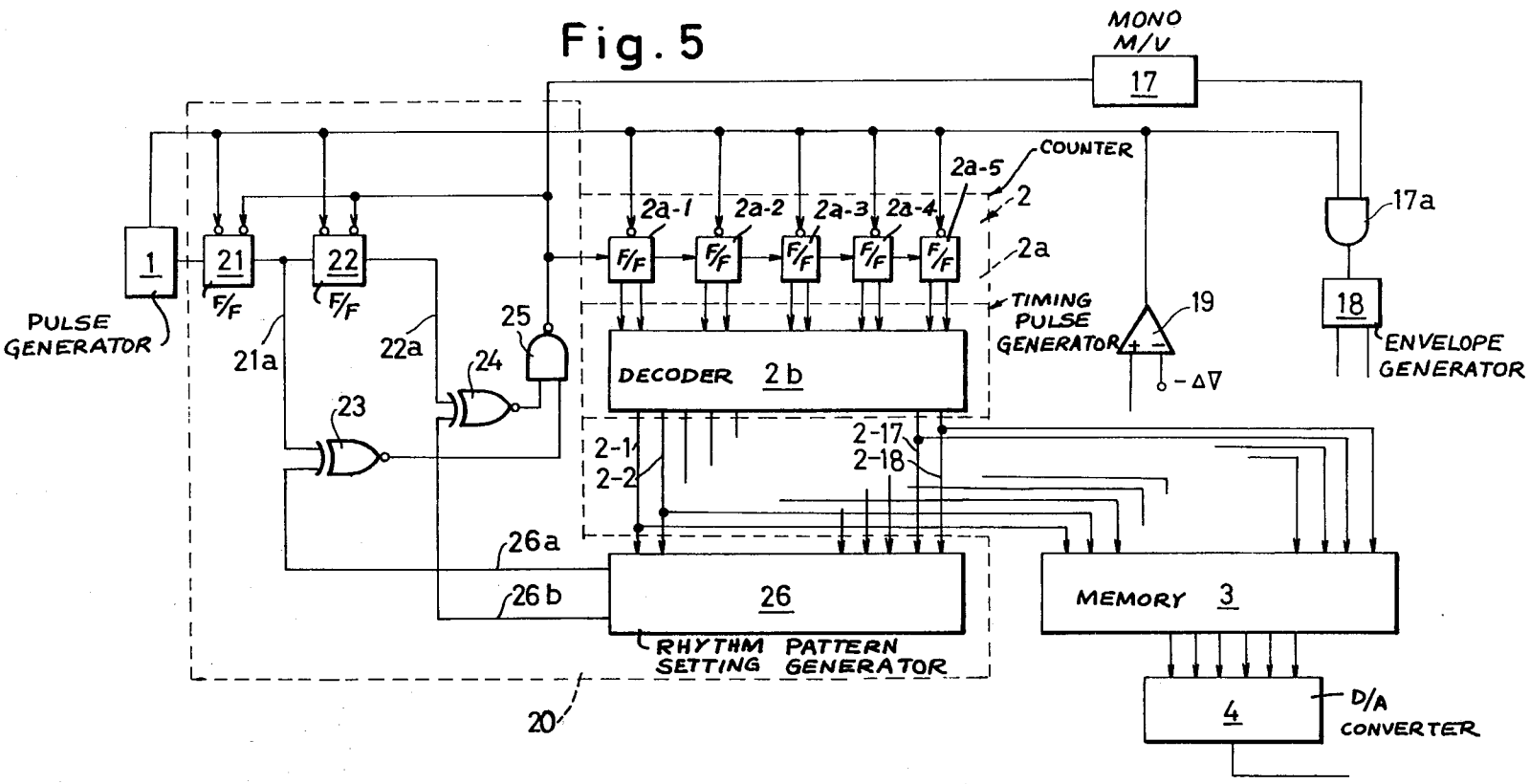
FIG. 5 is a block diagram showing another embodiment of the present invention.

FIG. 5 shows another embodiment of the present invention. In this embodiment, the pulse generator 1 of FIG. 1 is used, and a pulse width changing circuit 20 is interposed between the pulse generator 1 and the timing pulse generator 2, so that a rhythm pulse can be applied to the timing pulse generator 2 in almost the same manner as in the case of the aforedescribed rhythm pulse generator.

Thus, the pulse width changing circuit 20 includes two flip-flop circuits 21 and 22, two coincidence circuits 23 and 24, a NAND circuit 25 and a rhythm-pattern setting-circuit 26, the rhythm pattern setting circuit 26 including a read-only memory. The respective input terminals of the circuit 26 are connected to respective output terminals 2-1, 2-2 . . . . 2-18 of the timing pulse generator 2, and two output terminals 26*a*, 26*b* of the circuit 26 are connected to the coincidence circuits 23 and 24. In this embodiment, words as shown in Table 4 are memorized in respective addresses of the rhythm pattern setting circuit 26.

Table 4

| Address No. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| Output terminal a | 1 | 1 | 0 | 1 | 1 | 0 | 1 | 1 | 0 | 1 | 1 | 0 | 1 | 1 | 0 | 1 | 1 | 0 |
| Output terminal b | 1 | 0 | 1 | 1 | 0 | 1 | 1 | 0 | 1 | 1 | 0 | 1 | 1 | 0 | 1 | 1 | 0 | 1 |
| Tone length | ♩ | ♪ | ♩ | ♩ | ♪ | ♩ | ♩ | ♪ | ♩ | ♩ | ♪ | ♩ | ♩ | ♪ | ♩ | ♩ | ♪ | ♩ |

If, now, a key is depressed, in almost the same manner as in the foregoing example, the pulse generator 1 is driven, the counter 2*a* and the flip-flop circuits 21, 22 are reset, and the envelope signal forming circuit 18 is driven through the keying signal generating circuit 19*a*, so that a logic "1" is obtained at the first output terminal of the decoder 2*b*, and the first addresses of the memory circuit 3 and of the rhythm pattern setting circuit 26 are selected. Thus, the output terminals 26*a* and 26*b* of the rhythm pattern setting circuit 26 become "1, 1" as will be seen from the foregoing Table 4. In the meantime, the output pulses of the pulse generator 1 are frequency-divided by the flip-flop circuits 21 and 22, and when the output terminals 21*a* and 22*a* thereof become "1, 1" the outputs of the coincidence circuits 23, 23 become "1, 1", respectively, the output of the NAND circuit 25 becoming "0", and by the latter's falling output the counter 2*a* is driven, so that there is obtained a logic "1" at the second output terminal 2-2 of the decoder 2*b*, and at the same time the flip-flop circuits 21 and 22 are reset; also, when the output of the flip-flop circuits becomes "1, 0" the latter coincides with the output "1, 0" (the words in the 2nd address of the Table 4) of the rhythm pattern setting circuit 26, the output of the NAND circuit 25 falls from "1" to "0", and by that falling output the counter 2*a* is driven, and a logic "1" is obtained at the third output terminal of the decoder 2*b*. Thus, each time an output signal of the flip-flop circuits 21,22 and an output signal of the rhythm pattern setting circuit coincide with one another, the counter 2*a* is driven by the falling output of the NAND circuit 25, and thereby there are obtained at the output terminals 2-1, 2-2 . . . . of the decoder 2*b* timing pulses corresponding to the set values of the rhythm pattern setting circuit 26 as shown in FIGS. 6-1, 6-2, 6-3 to 6-6. Thus, any desired rhythm pattern can be obtained by the words in the addresses of the rhythm pattern setting circuit 26 being properly set.

Figure 7:
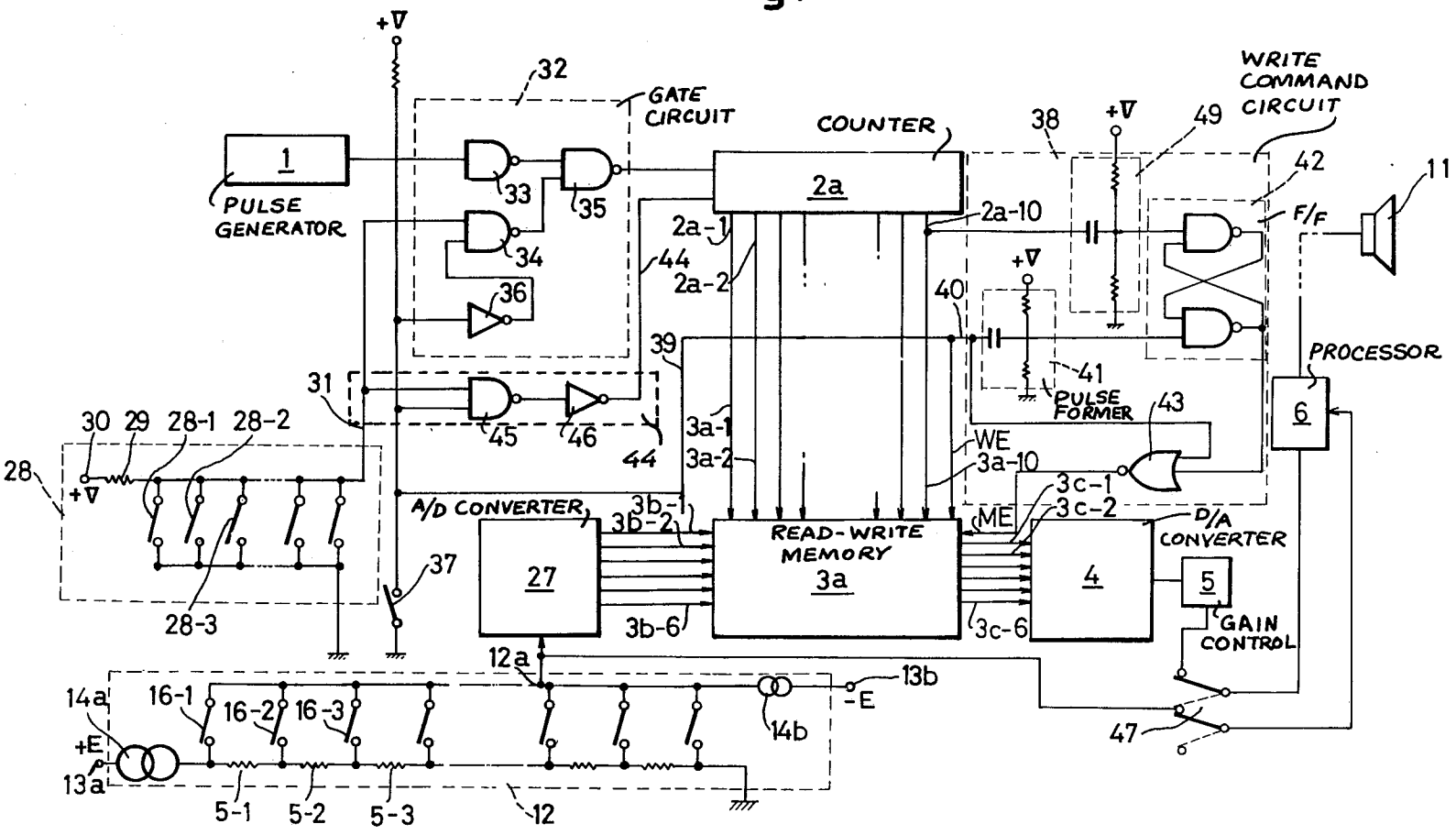

FIG. 7 shows a further embodiment example of the present invention, the memory circuit 3 being composed of a read-write memory 3*a*, and any desired words can be written thereinto by depressing a key. The read-write memory 3*a* shown in this Figure includes plural flip-flop circuits, the latter including a decoder identical to the decoder 2*a*, and having selective input terminals 3*a*-1 . . . . 3*a*-10, data input terminals 3*b*-1 . . . . 3*b*-6, output terminals 3*c*-2 . . . . 3*c*-6, a memory control terminal ME and a write-in terminal WE. The selective input terminals 3*a*-1 . . . . 3*a*-6 are connected to the counter 2*a*, and the data input terminals 3*b*-1 . . . . 3*b*-6 are connected to plural input terminals of an A-D converter 27, the latter being connected to the output terminals 12*a* of the voltage generating circuit 12. The key-switches 16-1, 16-2 to **16*n* have a second keying signal generating circuit 28 which includes key-switches 28-1, 28-2 to 28*n*, and stationary contacts of these key-switches 28-1, 28-2 to 28*n* are connected in common to the ground, and movable contacts thereof are connected in common to an electric source terminal 30 through a resistance 29, and to an output terminal 31. The output terminal 31 is connected to a gate circuit 32 interposed between the pulse generator 1 and the counter 2*a*. The gate circuit 32 includes a combination of NAND circuits 33, 34, 35 an inverter circuit 36, and a switch 37 for control of these circuits 33, 34, 35, 36. The switch 37 is further connected to a write-command circuit 38 for the read-write memory 3*a*. The write-command circuit 38 includes a lead 39 connecting the switch 37 to the write-in terminal WE, a pulse forming circuit 41, a flip-flop circuit 42, and a NOR circuit 43 interposed between a lead 40 and the memory control terminal ME for connecting the switch 37 to the latter, so that when the switch 37 is ON, the terminals WE, ME become low and write-in is performed, and on completion of the writing-in of each address the flip-flop circuit 42** is reversed, so that the terminal ME becomes high and thus the write-in is inhibited.

Numeral 44 denotes a reset circuit for resetting the counter **2*a* when the switch 37 is closed, and this circuit 44 includes a NAND circuit 45, and an inverter 46 connected to the switch 37, and the output terminal 31 of the key-switches 28-1, 28-2 to 28*n*.**

In almost the same manner as in the case shown in FIG. 1, plural output terminals **3*c*-1 . . . . 3*c*-n of the read-write memory 3*a* are connected to the D-A converter 4. Numeral 47 denotes a change-over switch which serves to directly control the VCO 7 by an output signal of the voltage generating circuit 12,** so as to confirm a tone corresponding to the word written in.

If, now, the switch 37 is ON, and the change-over switch 47 is changed over to the side of the output terminal **12*a* of the voltage generating circuit 12, as shown by dotted lines, the terminals WE and ME become low, and thereby the gate circuit 32 is interrupted by the NAND circuit 33 due to an output of the rhythm pulse generator 1, and is ready for passing of pulses generated by closing of the second key-switches 28-1, 28-2 to 28*n*, and the counter 2*a*** is reset.

If, then, the key of the tone $C_1$ is depressed, the key-switches 16-1, 28-1 are simultaneously closed. By closing of the key-switch 16-1, a voltage of a level corresponding to the tone $C_1$ can be obtained at the output terminals **12*a*, and the same is converted by the A-D converter circuit 27 into a digital signal "000000", and is applied to the read-write memory 3*a* through the data input terminals 3*b*-1, . . . . 3*b*-6. By closing of the key-switch 28-1,** a falling pulse *a* as shown in the same Figure is applied to the counter **2*a* through the NAND circuits 34 and 35 of the gate circuit 32, and an output of the counter 2*a* is applied to the selective terminals 3*a*-1 . . . . 3*a*-10 of the read-write memory 3*a*; the first address is selected by the internal decoder. Thus, "000000" is memorized in the first address. At that time, the voltage obtained at the output terminals 12*a* of the voltage generating circuit 12 is applied to the VCO 7, so that the tone $C_1$ can be obtained from the speaker 11,** and it can thus be confirmed that the tone $C_1$ has been memorized.

If, next, the key of the tone $E_1$ is depressed, in almost the same manner as above, a voltage corresponding to the tone $E_1$ is generated, and "00100" is outputted from the A-D converter 27, and at the same time the second address is selected and thus "000100" is memorized therein.

Thus, by depressing keys in succession, tones corresponding to respective depressed keys are memorized in digital signal form in respective addresses of the memory circuit **3*a*.**

Thus, if memorizing in the respective addresses is completed, a logic "1" of the last output terminal **2*a*-n of the counter 2*a* is applied through the pulse forming circuit 41 to the flip-flop circuit 42, whereby the circuit 42** is reversed so that the terminal ME may become high. Accordingly, any write-in is no longer possible, even if a key is depressed.

If the switch 37 is subsequently opened and the reversed switch 47 is changed over to a position shown by the solid lines, one input terminal of each of the NAND circuits 34 and 35 becomes high, so that a condition is obtained, where, if any of the keys are depressed, pulses from the rhythm pulse generator 1 are applied to the counter **2*a* through the NAND circuits 33, 35,** and the terminals WE, ME become both high.

If a key is then depressed, it operates in such a manner as mentioned in connection with FIG. 1, and the words memorized in the read-write memory **3*a*** are outputted in sequence for an arpeggio performance.

FIG. 8 shows an additional embodiment of the present invention. In this embodiment, a word converting circuit 50 for converting a word of major scale into a word of minor scale is interposed between the memory circuit 3 and the D-A converter 4, so that a performance of a minor scale is made possible by the words in the memory circuit 3 being left as those of major scale and being converted into words of minor scale.

The word converting circuit 50 includes exclusive OR circuits 51-1, 51-2 and 51-3 interposed between the second to fourth memory output wires 3-2 . . . . 3-4 and the memory circuit 3, an OR circuit 52 connected to the first to fourth output wires 3-1 . . . . 3-4, a NOR circuit 53 connected at one of its input terminals to the output terminal of the circuit 52, a switch 54 interposed between the other input terminal of the circuit 53 and ground, and an inverter 55 interposed between the second output wire 3-2 and the OR circuit 52, and output terminal of the NOR circuit 53 being connected to other input terminals of the exclusive OR circuits 51-1, 51-2 and 51-3. Numeral 45 denotes an electric source terminal.

Under the condition (major scale) that the switch 54 is opened as illustrated, an output of the NOR circuit 53 is "0", and the other input terminals of the respective exclusive OR circuits 51-1. 51-2, 51-3 are "0", so that respective words "0000" "0100" "0111", for instance, outputted form the memory circuit 3, are applied to the D-A converter 4, and a major scale performance is obtained.

For a minor scale performance to be obtained the switch 54 is closed, and "0000" is outputted from the memory circuit 3; an output of the OR circuit 52 is then a logic "1", and an output of the NOR circuit 53 is then a logic "0", and therefore in almost the same manner as above "0000" is applied to the D-A converter 4. If, "0100" is then outputted, an output of the OR circuit 52 becomes "0", and an output of the NOR circuit 53 becomes "1", and therefore an output of the exclusive OR circuits 51-1, 51-2 and 51-3 becomes "0011" and consequently "0011" is fed to the D-A converter 4, being a word of the minor scale. If "0111" is outputted from the memory circuit, an output of the OR circuit 52 becomes "1", and an output of the NOR circuit 53 becomes "0", and therefore the word "0111" is applied to the D-A converter 4. Thus, only the word of the major scale "0100" (tone $E_1$) converted into a word of the minor scale "0011" (tone $D_1$#) is applied to the D-A converter 4, and thereby a minor performance is obtained.

In the case of this embodiment, it is only required that ". . . . 100" is converted into ". . . . 011", so that, as will be clear from the Table 1, converting into the minor scale becomes possible only in the first octave, the third octave and the fifth octave. Accordingly, an arpeggio performance becomes possible, where, for instance, C E G, C E G, . . . . in the first, third and fifth octaves are repeated.

Thus, according to the present invention, by only a single key being kept depressed, an arpeggio performance is obtainable automatically during that key depression period, and since the arpeggio performance is obtained from a tone corresponding to the key being depressed, an arpeggio performance corresponding to the playing of an electronic organ or the like can be carried out, and if a memory circuit includes a read-write memory, a word corresponding to a key can be memorized by depression of that key in that memory and also be reproduced, and consequently any desired arpeggio performance can be obtained at any time, and it becomes additionally possible that when a word of a major scale has been memorized in the memory circuit, a performance of converting it into a corresponding minor scale can be obtained.

What is claimed is:

1. An automatic arpeggio musical instrument comprising:

pulse generator means having a plurality of keys for generating periodic pulses by depression of one of said keys, each of said keys generating a voltage;

a timing pulse generator connected to said pulse generator means;

memory means connected to said timing pulse generator for generating digital signals of a musical scale;

digital-to-analog converter means connected to said memory means for converting the digital signals into analog signals;

processor means connected to said converter means for selectively adding and subtracting the key-generated voltage to said analog signals and for generating an output voltage therefrom; and a voltage-controlled connected to said processor means for controlling said output voltage.

2. The musical instrument according to claim 1 wherein said pulse generator means comprises a rhythm pulse generator.

3. A musical instrument according to claim 1, further comprising a pulse-width change circuit interconnected between said pulse generator means and said timing pulse generator.

4. A musical instrument according to claim 1 wherein said memory means comprises a read-only memory.

5. A musical instrument according to claim 1, wherein said memory means includes a read-write memory having a plurality of addresses for storing a plurality of words, respectively, said read-write memory having an input and an output, and further comprising analog-to-digital converter means having an input and an output, the analog-to-digital converter means output being connected to the read-write memory input, voltage generator means for generating said voltage and having an output connected to the analog-to-digital converter means input, and keying generator means connected to said timing pulse generator for generating a plurality of pulses following the depression of one of said keys, each of said pulses selecting said addresses, respectively, in sequence, whereby one of said words corresponding to a depressed key is selected and memorized in said memory means.

6. A musical instrument according to claim 1 further comprising word converting circuit means for converting a word of a major scale into a word of a minor scale, said word converting circuit being interconnected between said memory means and said digital-to-analog converter means.

* * * * *